US006036243A

United States Patent [19]

Blom

[11] Patent Number: 6,036,243

[45] **Date of Patent: *Mar. 14, 2000**

[54] LOW PROFILE DOOR HANDLE ASSEMBLY

[75] Inventor: Marcia K. Blom, Albert Lea, Minn.

[73] Assignee: Truth Hardware Corporation, Owatonna, Minn.

[ * ] Notice: This patent is subject to a terminal disclaimer.

[21] Appl. No.: 08/769,345

[22] Filed: Dec. 19, 1996

Related U.S. Application Data

[63] Continuation of application No. 08/528,549, Sep. 15, 1995, abandoned, which is a continuation-in-part of application No. 29/041,277, Jul. 11, 1995, Pat. No. Des. 389,722.

[51] Int. Cl.[7] ..... F05B 3/00

[52] U.S. Cl. ..... 292/336.3; 292/347

[58] Field of Search ..... 16/110 R, 124; 70/100, 95–99, DIG. 58, DIG. 67; 292/336.3, 352, DIG. 46, 347; D8/300–302, 315–319

[56] References Cited

U.S. PATENT DOCUMENTS

| | | | |
|---|---|---|---|
| D. 188,040 | 5/1960 | Henshaw | D8/319 |
| D. 206,058 | 10/1966 | Amdal | D8/316 |
| D. 209,277 | 11/1967 | Carsello | D8/319 |
| D. 209,813 | 1/1968 | Clayton | D8/319 |
| D. 226,301 | 2/1973 | Dushane, Jr. | D8/302 |
| D. 291,405 | 8/1987 | Finesman et al. | D8/317 |
| D. 329,369 | 9/1992 | Martin et al. | D8/302 |
| D. 356,486 | 3/1995 | Lin | D8/319 |
| 773,835 | 11/1904 | White | 16/110 R |
| 1,202,433 | 10/1916 | Rubinstein | 16/110 R |
| 1,609,973 | 12/1926 | Shonnard et al. | 16/124 |
| 1,824,345 | 9/1931 | Hardwick | 16/124 |
| 2,203,030 | 6/1940 | Pehrson | 16/124 |
| 2,964,344 | 12/1960 | Rich | 292/175 |
| 2,990,208 | 6/1961 | Miller | 70/97 |
| 3,046,776 | 6/1962 | Marotto et al. | 70/97 |
| 4,362,328 | 12/1982 | Tacheny et al. . | |
| 4,754,624 | 7/1988 | Fleming et al. . | |
| 4,973,091 | 11/1990 | Paulson et al. . | |
| 5,092,144 | 3/1992 | Fleming et al. | 70/95 |
| 5,404,617 | 4/1995 | Ambasz | 16/124 |
| 5,582,442 | 12/1996 | Nolte | 292/101 |

FOREIGN PATENT DOCUMENTS

| | | | |
|---|---|---|---|
| 194700 | 6/1990 | European Pat. Off. | 292/336.3 |
| 1507819 | 12/1967 | France | 16/110 R |
| 1562374 | 2/1969 | France | 16/110 R |

OTHER PUBLICATIONS

Truth brochure "Hard Working Hardware for Sliding Patio Doors" (1991).

Technology Group News Release brochure (undated).

Unknown Handle Origin (undated).

Hoppe brochure "Sliding door handle sets", p. 15 (undated).

Unknown Handle Origin "Vinyl Sliding Patio Doors" (undated).

Unknown Handle Origin "Sliding door handles" (undated).

Hardware Technologies Brochure "Effortless Efficient and Attractive" (undated).

Fullex U.S. Inc. Brochure "Multi–Point sliding patio door lock" (undated).

Sash Controls Brochure "Curio Brass Handle Set" (undated).

*Primary Examiner*—Teri Pham

*Attorney, Agent, or Firm*—Wood, Phillips, VanSanten, Clark & Mortimer

[57] ABSTRACT

A low profile door handle having interior and exterior parts is disclosed. The interior part of the door handle comprises a body and a handle portion having upper and lower ends attached to the body. The handle portion has a top having a high area at its center and low areas at its upper and lower ends. The distance between the top of the handle portion and the body gradually and continuously decreases from the center to the upper and lower ends so that the top curves downward smoothly from the high area to the low areas. The contour of the body is similarly curved so that the door handle may be used in conjunction with horizontal blinds without interfering with operation of the blinds or creating a large bulge.

8 Claims, 6 Drawing Sheets

LOW PROFILE DOOR HANDLE ASSEMBLY

CROSS-REFERENCE TO RELATED APPLICATION

This application is a continuation, of application Ser. No. 08/528,549, filed Sep. 15, 1995, abandoned, which is a continuation-in-part of application Ser. No. 29/041,277 filed Jul. 11, 1995, now U.S. Pat. No. D.389,722.

BACKGROUND OF THE INVENTION

1. Field of the Invention

The present invention relates to door handles, and more particularly to low profile door handles that may be used with sliding doors such as those in use in homes.

2. Description of the Prior Art

Sliding doors and handles for use with such doors are known in the art. Typical handles for such doors include interior and exterior handle parts connected to a latch mechanism through which the door may be locked. Such prior art door handles have included bodies mounted to the door and handle portions attached to and extending outwardly from the bodies. These handle portions may be grasped and pulled or pushed to slide the door open or closed. A variety of handle types have been employed with sliding doors. Many of the sliding doors have been of the glass type to allow for the admission of light and for viewing through the glass. Such sliding glass doors enjoy frequent use as patio doors.

Particularly in the home and office environments it has also been desirable to limit or exclude the light entering through the glass of such sliding glass doors or to limit viewing through the doors. Hence it is desirable in many instances to use blinds in combination with the door. Such blinds typically have a plurality of parallel horizontal slats that are adjustable in several ways: they may be raised or lowered to allow light to enter or to block the admission of light, to limit the amount of light entering through the door, or to block or allow for full or partial visibility through the door; and the angles of the slats may be varied to control the amount of light entering or the visibility through the blinds.

However, difficulties have been encountered when using such blinds in combination with standard sliding door handles. The handles frequently interfere with the operation of the blinds. When the blinds are raised or lowered, they may catch on or collide with edges, gaps or surfaces on the handles. When the blinds are operated to change the angle of the slats, the individual slats may catch on the parts of the handles as well. To overcome these difficulties, the operator must frequently dislodge the blinds from the handle parts or hold the blinds away from the handle parts to avoid interference. And in some instances, the slats of the blinds may become damaged when catching on the door handle. Moreover, when the blinds are down and overlying the door handle, the blinds may bulge outwardly at the door handle in an unsightly manner. Similar problems exist when operating vertical blinds.

BRIEF SUMMARY OF THE INVENTION

The present invention addresses the problem of providing a sliding door handle that is compatible with the use of blinds, and particularly, with horizontal blinds. The present invention provides a sleek low profile door handle that presents no surface or edge or gap to catch or collide with the slats of the blinds and minimizes displacement of the hanging blinds. Instead, the handle provides a lead in design.

When the blinds are adjusted, the slats smoothly slide over the handle. While addressing these needs, the present invention also provides such a door handle with a thumb turn that allows a latch mechanism to be operated; the thumb turn is positioned to allow for convenient and effective operation while minimizing the potential for interference with operation of the blinds.

In one aspect the present invention provides a low profile door handle having an interior part comprising a body and a handle portion having upper and lower ends attached to the body. The handle portion has a top having a high area spaced farthest from the body in one direction and low areas closest to the body at its upper and lower ends. The distance between the top of the handle portion and the body in that one direction gradually and continuously decreases from the center to the upper and lower ends so that the top curves smoothly from the high area to the low areas.

In another aspect, the present invention provides a low profile door handle assembly including an interior part comprising a body having an edge and a handle portion. The handle portion has upper and lower ends attached to the body and a grip extending between the upper and lower ends. The grip has a high area and a far area. The grip curves from the upper and lower ends toward the high and far areas so that the horizontal and vertical distances between said edge and said grip continuously increase from said upper and lower ends to the high area and far area.

DETAILED DESCRIPTION OF THE PREFERRED EMBODIMENT

Figure 2:
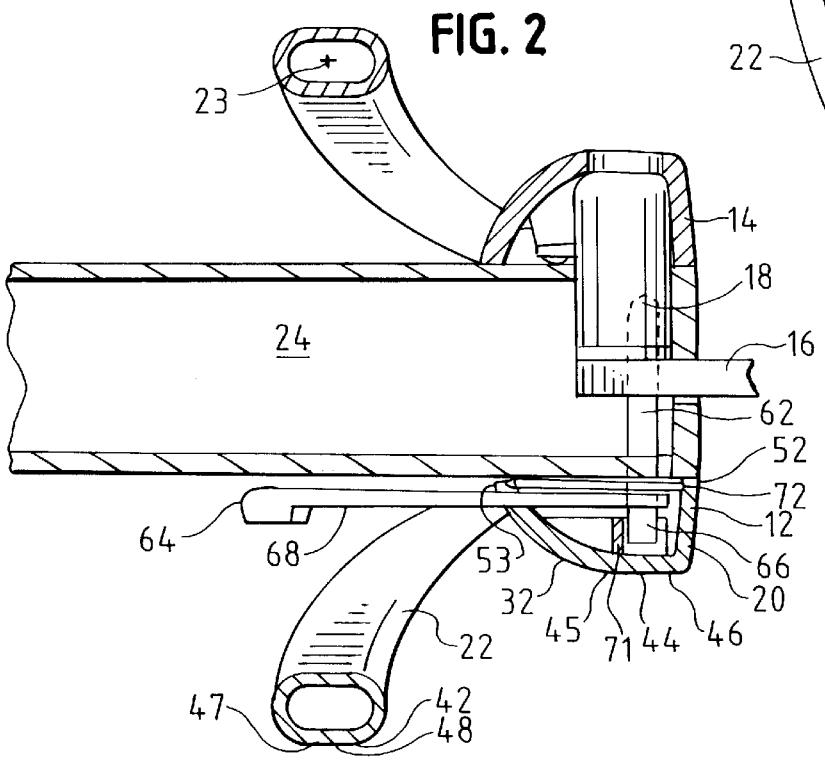
FIG. 2 is an enlarged cross-section taken along lines 2—2 of FIG. 1.
Figure 6:
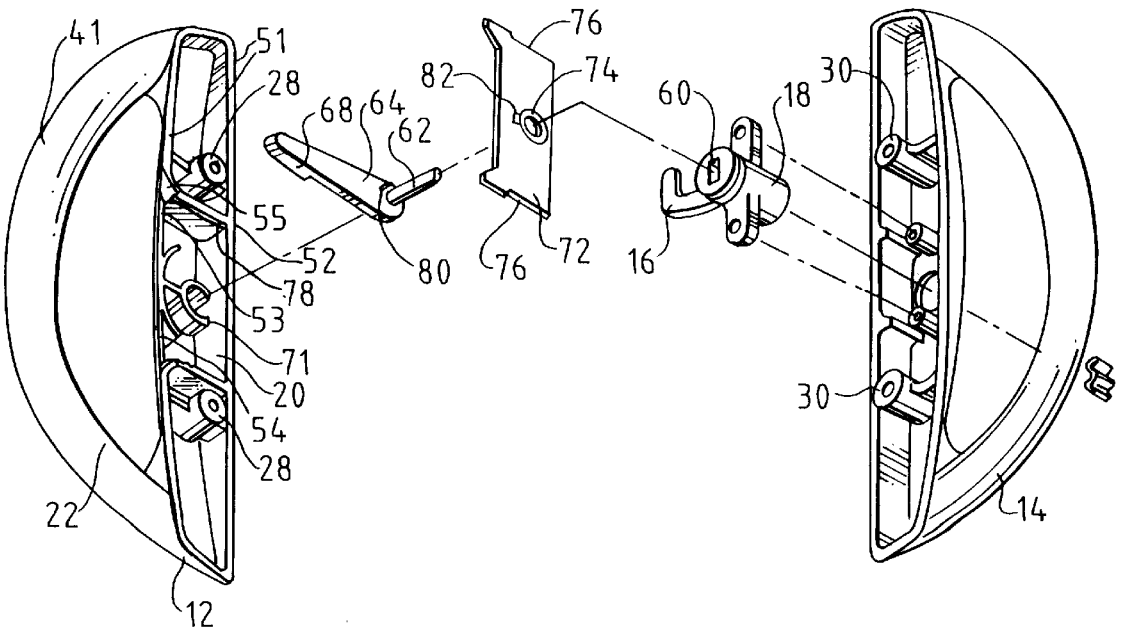
FIG. 6 is an exploded view of both the interior and exterior parts of the door handle, showing the locking and latching mechanisms as well.
Figure 7:
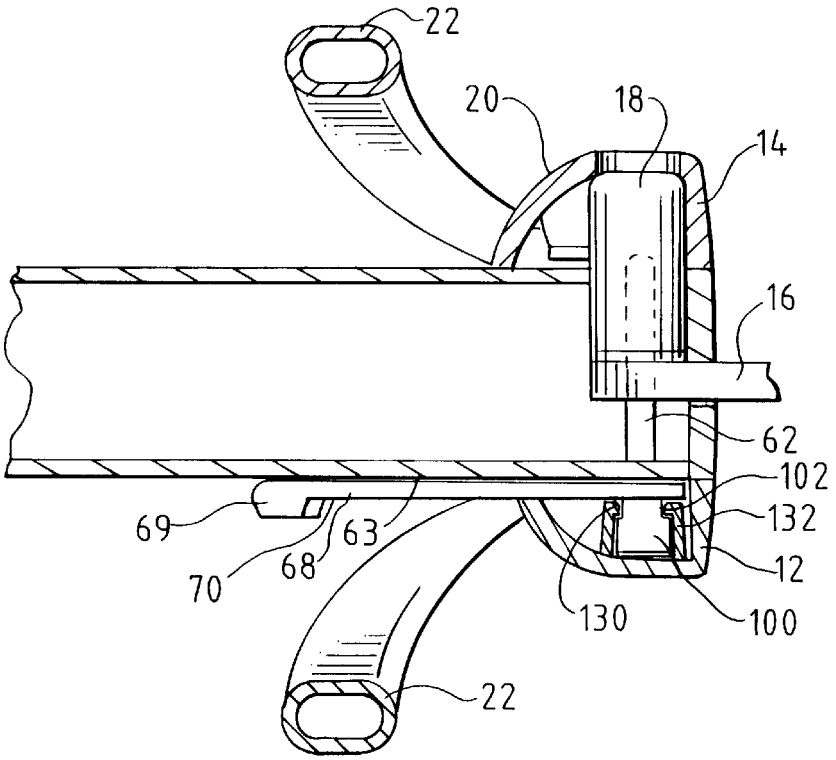
FIG. 7 is an enlarged cross-section of an alternative embodiment of the invention, taken along line 2—2 of FIG. 1.
Figure 8:
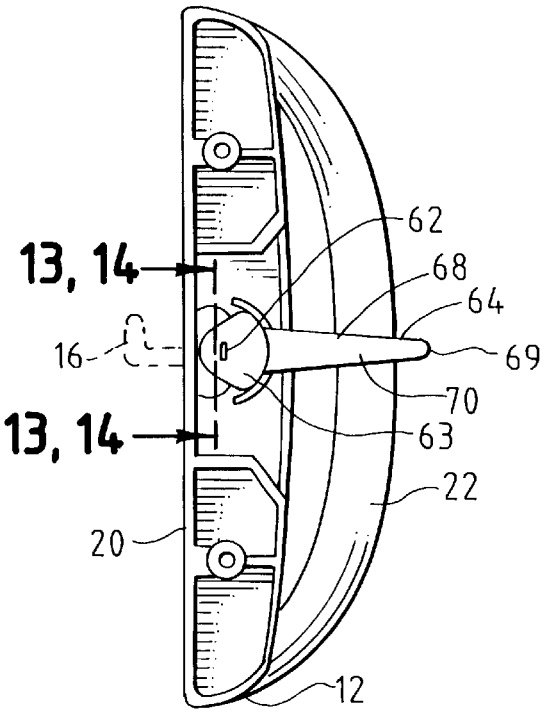
FIG. 8 is a bottom plan view of the alternative embodiment of the interior part of the door handle of FIG. 7, removed from the door, with the latch mechanism shown in phantom, and showing the thumb turn in place on the body of the interior part of the door handle.

The attached drawings illustrate an embodiment of the door handle of the present invention. The illustrated door handle assembly 10 has two sides, an interior side or part 12 and an exterior side or part 14, as best seen in FIGS. 2 and 6. And as also best seen in FIGS. 2 and 6, the illustrated door handle assembly 10 also includes a latch mechanism 16 and a lock mechanism 18 operably attached to the latch mechanism 16 so that the door may be locked in the latched position and opened with a key.

Figure 1:
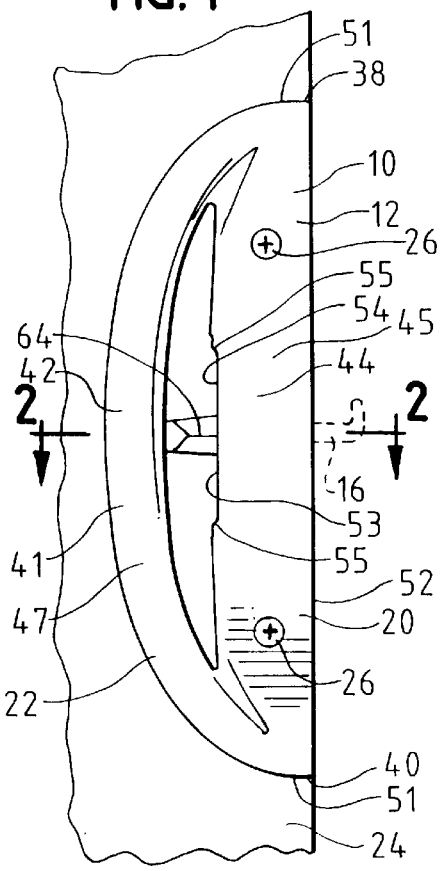
FIG. 1 is a partial front elevation of the interior side of the door handle of the present invention, in place on a door, with a latch mechanism shown in phantom.

As shown in FIG. 1, the interior part 12 of the illustrated embodiment includes a body portion 20 and a handle portion 22. The handle portion 22 is substantially convex about a center line 23 as shown in FIG. 2. In the illustrated embodiment, the interior and exterior parts 12, 14 of the door handle assembly 10 may be mounted to the door 24 by screws 26 extending through bosses 28 in the body portion 20 into and through the door 24 and into threaded bosses 30 in the exterior part or side 14 of the door handle. The illustrated screws are flush with the surface of the body portion 20 of the interior side so as not to present an edge that could catch the blinds.

Figure 3:
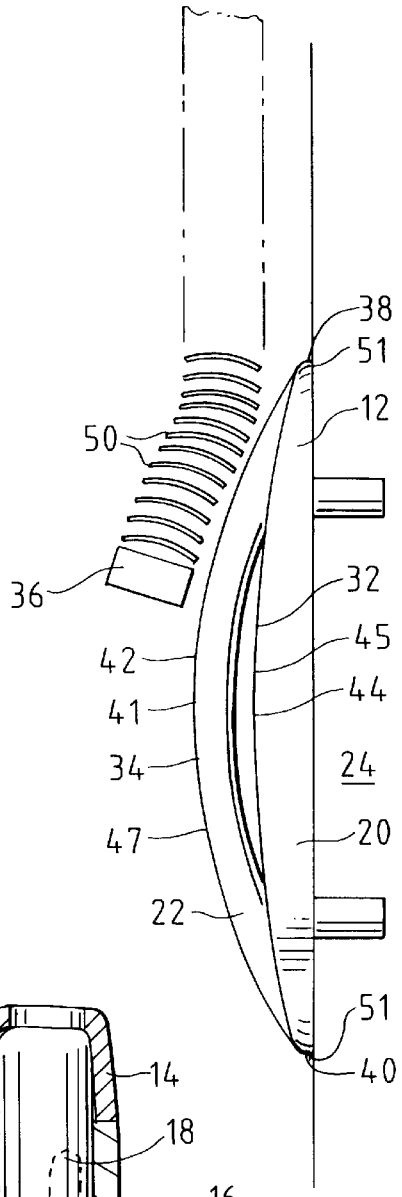
FIG. 3 is a side elevation of the interior of the door handle of FIG. 1, with blinds disposed alongside the door handle.
Figure 5:
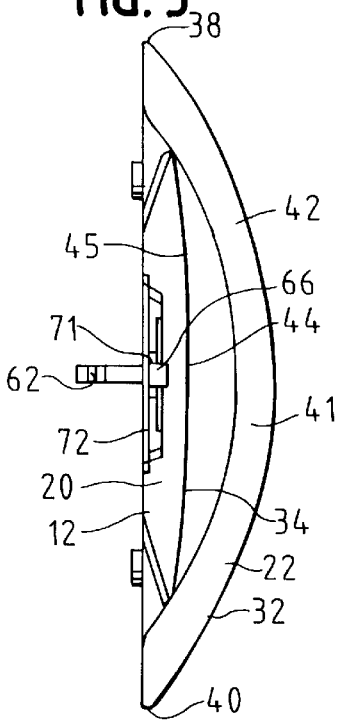
FIG. 5 is a side view of the interior part of the door handle of FIG. 4.

To minimize or prevent interference with operation of blinds used on doors on which the handle of the present invention is used, the body 20 and handle portion 22 of the interior part 12 of the handle 10 are shaped to provide smooth continuous profiles or contours 32, 34, as shown in FIGS. 3 and 5. As shown, both profiles or contours 32, 34 are free from any gaps, protrusions, edges or surfaces that could substantially interfere with the free raising, lowering, opening or closing of horizontal blinds 36 mounted on the door.

As shown in FIGS. 1 and 3, the interior side of the illustrated handle has upper 38 and lower 40 ends. In the illustrated embodiment, the upper end 38 serves as the upper end for both the handle portion 22 and body 20 of the interior part 12, and the lower end 40 serves as the lower end for both the handle portion 22 and body 20 of the interior side. Between the upper and lower ends 38, 40, the handle portion 22 has a raised grip 41 that has a center 42, and the body portion 20 also has a raised center 44. In the illustrated embodiment, the center 44 of the body portion 20 is the high area or point of the body's profile or contour 32; the body smoothly curves from the high area or point 44 to the upper and lower ends, 38, 40, which define low areas so that the body has an overall partial oval profile or contour 32. Similarly, the grip 41 of the handle portion 22 has a high area or point at its center 42, and it smoothly curves downwardly to its low areas or points at the upper and lower ends 38, 40 so that the grip 41 of the handle portion also has an overall partial oval profile or contour 34. The contours 32, 34 of both the body 20 and handle portion 22 are smooth and uninterrupted.

As shown in FIG. 2, the top or outermost surface 45 of the body portion 20 may have a flat area 46, and the top or outermost surface 47 of the handle portion 22 may also have a flat area 48. In the illustrated embodiment, the flat areas 46, 48 do not present any angular edge on which the horizontal slats 50 of the blinds 36 could catch. To the contrary, any edge is rounded and generally perpendicular to the horizontal slats 50.

The distance between the top or outermost surface 47 of the handle portion 22 and the body 20 gradually and continuously decreases from the center 42 of the grip 41 to the upper and lower ends 38, 40 so that the top 47 smoothly curves downward from the high area 42 to said low areas 38, 40 to give the handle its smooth, partial oval profile or contour 34. The vertical distance between the top or outermost surface 45 of the body and its ends 38, 40 decreases gradually and continuously from the center to the upper and lower ends 38, 40, and more particularly, to the edge 51 at the perimeter of the body. The decrease in vertical distance is more gradual for the body portion, giving it a less curved contour.

As used herein, high point or area, low point or area, and far point or area refer to the spacing or distance between a point or area on one of the surfaces and a reference on the body of the handle. The reference is the edge 51 at the perimeter of the body, and the high point or area on the handle 42 and the high point or area on the body 44 are those places on the handle and body that are spaced farthest from the edge 51 in one direction. That one direction, referred to herein as the vertical direction, is the direction perpendicular to the plane in which the edge 51 lies. The far point or area of the handle 42 is that point or area that is spaced farthest from the edge 51 in another perpendicular direction, within the plane of the edge 51. The tops or outermost surfaces 45, 47 of the body and handle are those that are spaced farthest from the edge 51.

In the illustrated embodiment, the handle portion 22 is joined to the body portion 20 at its upper and lower ends 38, 40 in a smooth curved uninterrupted contour at the junctions. The interior part 12 may be cast as one piece to allow for such smoothly contoured junctions without any edges or seams that could catch an adjacent slat 50.

In the illustrated body 20 of the interior part 12 of the door handle assembly 10, the edge 51 at the perimeter of the body has an outer side 52 and inner side 53. As shown in FIG. 1, the outer side 52 of the edge 51 is straight and extends from the upper 38 to the lower 40 end of the body. The inner side 53 of the edge 51 is generally parallel to the outer side 52, and includes a cut-out portion 54 with spaced stops 55.

The far area or point of the handle portion at the center 42 is spaced from outer side 52 of the edge 51, and both the horizontal and the vertical distance between the top 47 of the handle portion and the outer side 52 of the edge 51 gradually and continuously decreases between the far area or point 42 and the upper and lower ends 38, 40 of the handle portion.

Also as shown in FIG. 2, the center 42 of the handle portion 22 is offset from the body portion 20 in two directions, that is, both vertically and horizontally. This offset allows the users to grasp the handle at the central area and wrap their fingers around the handle portion without interference from the body portion, and minimizes the height of the handle necessary to allow for comfortable use of the handle. Thus, the offset minimizes displacement and bulging of the blinds. In the illustrated embodiment, the top surface 47 of the handle portion 22 defines a far point or area at its center 42, coinciding with the high area. The vertical and horizontal distances between this high and far area or point 42 and the outer side 52 of the edge 51 is greater than the vertical and horizontal distances between the high area 44 of the body and this side 52 of the edge 51.

The handle 22 curves from said upper and lower ends 38, 40 toward said high and far area 42 so that the horizontal and vertical distances between the outer side 52 of the edge 51 and the handle 22 continuously increase from said upper and lower ends 38, 40 to the high area and far area 42. Similarly, the top surface 45 of the body 20 curves from said upper and lower ends 38, 40 toward the high area 44 of the body so that the vertical distance between the outer side 52 of the edge 51 and the top surface 45 of the body 20 continuously increases from said upper and lower ends 38, 40 to said high area 44. This freedom from change in direction helps to assure that neither the body nor the handle portion will catch or collide with adjacent blinds.

As is clear from the Figures, particularly FIGS. 2–3, the handle portion 22 includes one side generally facing the door 24 when the body portion 20 is mounted to the door 24, and a second, opposite side generally facing away from the door 24 when so mounted. Both sides of the handle portion 22 include portions corresponding to the high area 42.

As shown in FIGS. 2 and 6, a typical door handle assembly 10 includes a lock mechanism 18 that is held partially in an aperture within the door 24 between the exterior 14 and interior 12 parts of the door assembly 10. As will be understood by those skilled in the art, the lock mechanism is generally operable from the exterior part 14 of the door handle assembly by use of a key (not shown). The lock mechanism 18 is operably connected to the latch mechanism 16. As shown in FIG. 6, the latch mechanism 16 includes a rectangular aperture 60 exposed toward the interior part 12 of the door handle. This rectangular aperture 60 is provided to receive a rectangular latch control post 62 extending perpendicularly outward from a thumb turn 64. The thumb turn also includes a cylindrical pivot post or boss or member 66 that is coaxial with the rectangular post but extends from the opposite side of the thumb turn 64. The thumb turn also includes a lever arm 68 that may be operated to pivot the thumb turn to thereby rotate the latch into and out of the locked positions.

The illustrated thumb turn 64 is pivotally mounted in the body portion of the interior side of the door handle, at the central area 44 of the body portion. The underside of the body portion has a mounting member 71 defining a cylindrical opening to receive and hold the cylindrical pivot post 66 while allowing the post to be pivoted. To hold the thumb turn 64 in place, a back cover plate 72 may be disposed on one side of the thumb turn as shown for the first illustrated embodiment. The back cover plate 72 has an aperture 74 through which the rectangular latch control post 62 extends. It is held in place on the interior part 12 of the handle against the thumb turn 64 by its opposing side edges 76 each being held in a receiving channel between a pair of undercut tabs 78 in the underside of the body portion 44.

The illustrated back cover plate 72 is made of a flexible material so that during assembly, the rectangular latch control post 62 may be placed to extend through the aperture 74 in the back cover plate 72. Then the combination may be slid into place on the interior side of the latch assembly. Because of the flexibility of the back cover plate 72, it will flex as the cylindrical pivot post is slid over the edge of the body and mounting member 71 and supporting structures in the body. When the cylindrical pivot post 66 meets the aperture of the mounting member 71, the cylindrical pivot post snaps into place in the aperture, relieving the flex in the back cover plate. The thumb turn 64 is thus held in place for pivotal movement.

Figure 4:
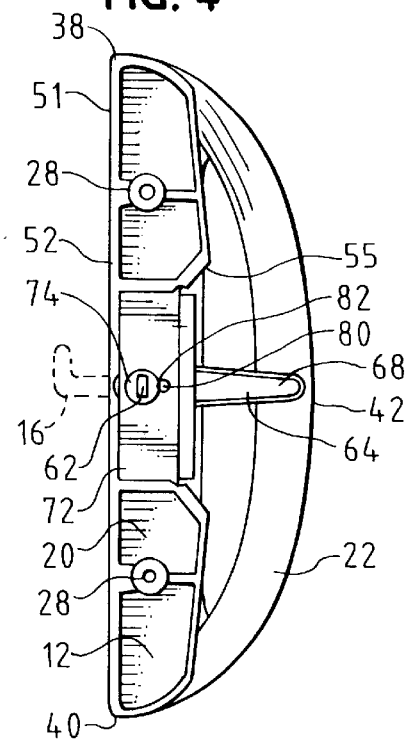
FIG. 4 is a bottom plan view of the interior part of the door handle, removed from the door, with a latch mechanism shown in phantom.

For ease of manufacture and simplicity of painting the door handle assembly, it may be desirable to temporarily maintain the position of the thumb turn 64 so that the greatest area of the thumb turn is exposed for painting, generally in the position shown in FIGS. 1 and 4. In the first illustrated embodiment of the present invention, the thumb turn 64 is held in this position by a small diameter pin 80 extending outwardly from one side of the thumb turn 64 and through a mating aperture 82 in the back cover plate 72. The small diameter pin 80 and mating aperture 82 are positioned so that the thumb turn will be held in the position shown in FIGS. 1 and 4. The entire part may then be painted. After painting, the thumb turn 64 may be cycled up and down to break the small diameter pin 80 and free the thumb turn for pivoting as desired. In the illustrated embodiment, the mating aperture 82 for the small diameter pin 80 is disposed adjacent the aperture 74 for the rectangular latch control post 62. During assembly, the thumb turn and back cover plate may be assembled by inserting both the rectangular latch control post 62 and small diameter pin 80 into their respective apertures 74, 82 prior to sliding the combination into place on the body 20. Further details of this structure and method of painting such latch assemblies are given in the application for United States patent filed by Raul Padilla, Jr. entitled "Thumb Turn With Small Diameter Pin" filed Sep. 15, 1995 as U.S. Ser. No. 08/528,550; the complete disclosure of that patent application is fully incorporated by reference herein.

Another embodiment of a thumb turn assembly that may be useful with the handle assembly of the present invention is shown in FIGS. 7–17. The alternative embodiment illustrated in those Figures is that disclosed in the application for United States Patent filed by Douglas A. Nolte entitled "Latch Assembly and Manufacturing and Painting Processes" Sep. 15, 1995 as U.S. Ser. No. 08/529,189, issued Dec. 10, 1996 as U.S. Pat. No. 5,582,442. The complete disclosure of that patent application is fully incorporated by reference herein.

In the embodiment of FIGS. 7–17, the cylindrical boss 66 has an outer cylindrical surface 100 and a circumferential groove 102 near the juncture of the cylindrical boss 66 and the lever arm 68 of the thumb turn 64. The diameter of the circumferential groove 102 is less than the diameter of the outer cylindrical surface 100 of the boss 66. The cylindrical boss has a free end face 104 opposite the lever arm 68 and a pair of diametrically opposed pockets 106 disposed between the free end face 104 and the circumferential groove 102. The pockets 106 are recessed from the outer cylindrical surface 100 of the boss 66.

Figure 10:
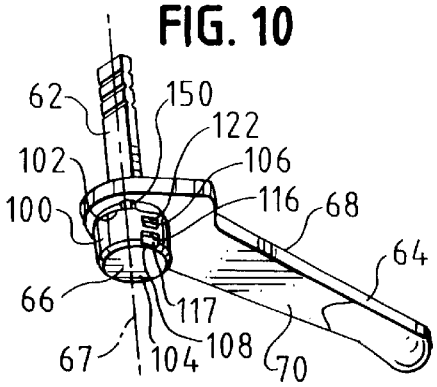
FIG. 10 is a perspective view of the thumb turn or pivoting member of the alternative embodiment.
Figure 11:
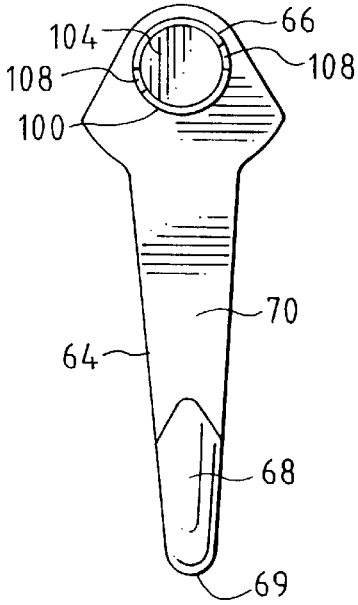
FIG. 11 is a bottom plan view of the thumb turn of FIG. 10.
Figure 12:
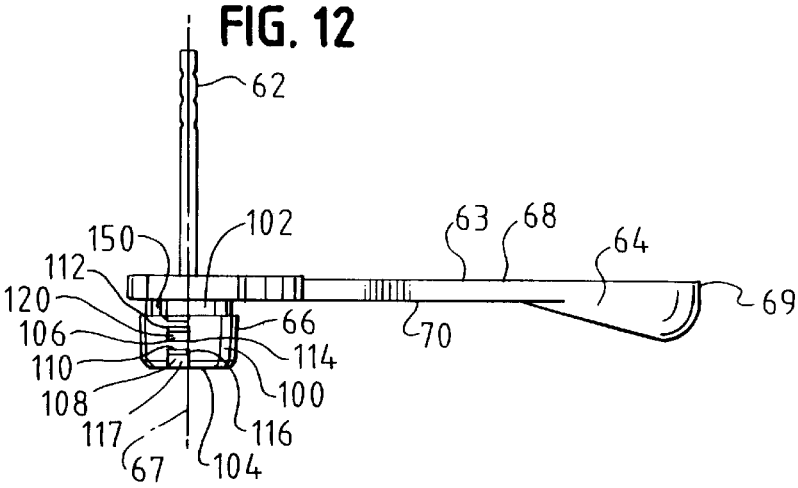
FIG. 12 is a side view of the thumb turn of FIG. 10.

In this embodiment, the cylindrical boss 66 also has a pair of vertical grooves 108, each vertical groove being positioned between the corresponding pocket 106 and the free end face 104 of the cylindrical boss 66, the vertical grooves being recessed from the outer cylindrical surface of the cylindrical boss. The vertical grooves may commence at the free end face of the cylindrical boss, as shown in FIGS. 10 and 12. In the illustrated embodiment, the vertical grooves and pockets are diametrically opposed, as shown in FIG. 11.

Figure 15:
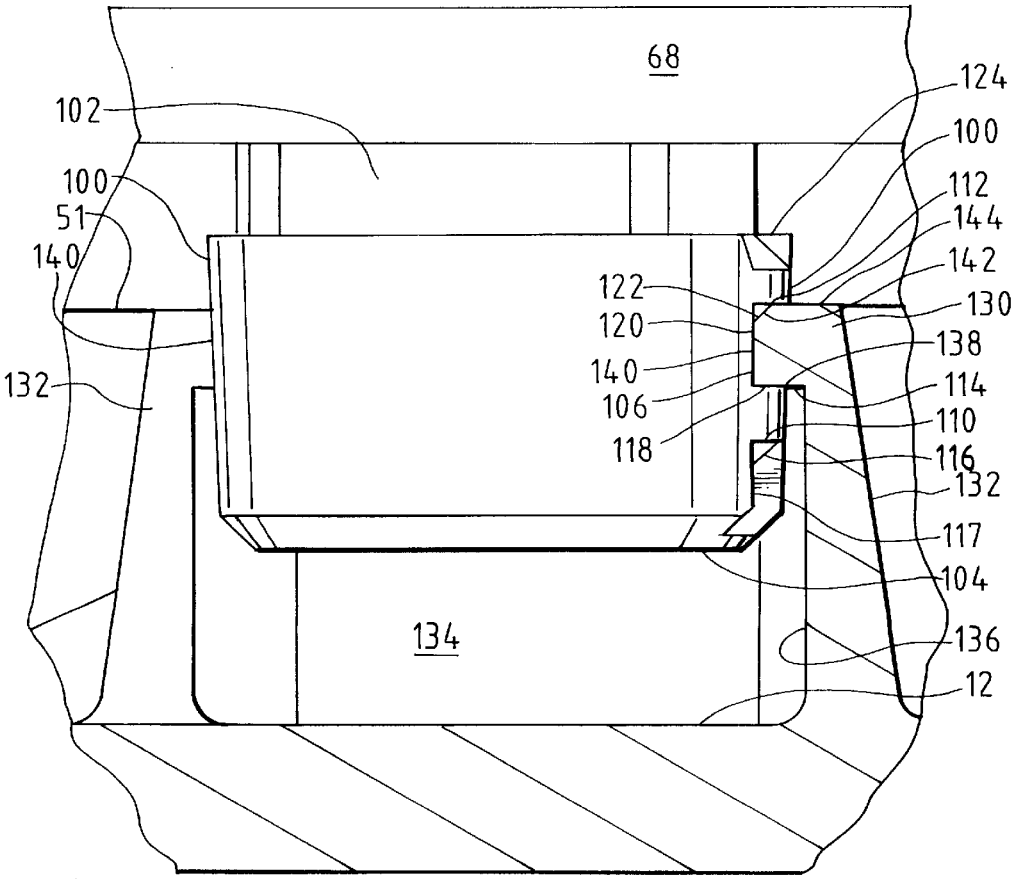
FIG. 15 is a partial enlarged detail of the structure of FIG. 13.

As best seen in FIG. 15, each vertical groove 108 has an upper edge 110 and each pocket has a top edge 112 and a bottom edge 114, all of the edges being at the outer cylindrical surface of the boss. Each vertical groove 108 has a ramped surface 116 leading from the recess 117 to the upper edge 110 of the vertical groove. Each pocket 106 has a flat horizontal surface 118 leading from the recess 120 to the bottom edge 114 and each pocket has a ramped surface 122 leading from the recess 120 to the top edge 112. In the illustrated embodiment, an additional ramped surface 124 leads from the outer cylindrical surface 100 to the circumferential groove 102.

The vertical grooves 108, pockets 106 and circumferential groove 102 all are sized to accept the free hook or horizontal ends 130 of a pair of cantilever arms 132 that extend outwardly from and are connected at one end to the underside of the body 20 of the interior part 12. In the illustrated embodiment, the cantilever arms 132 are diametrically opposed, and the free hook or horizontal ends face inwardly toward one another. The illustrated cantilever arms are separated by ribs 134 which also extend outwardly from the underside of the body 20.

Figure 16:
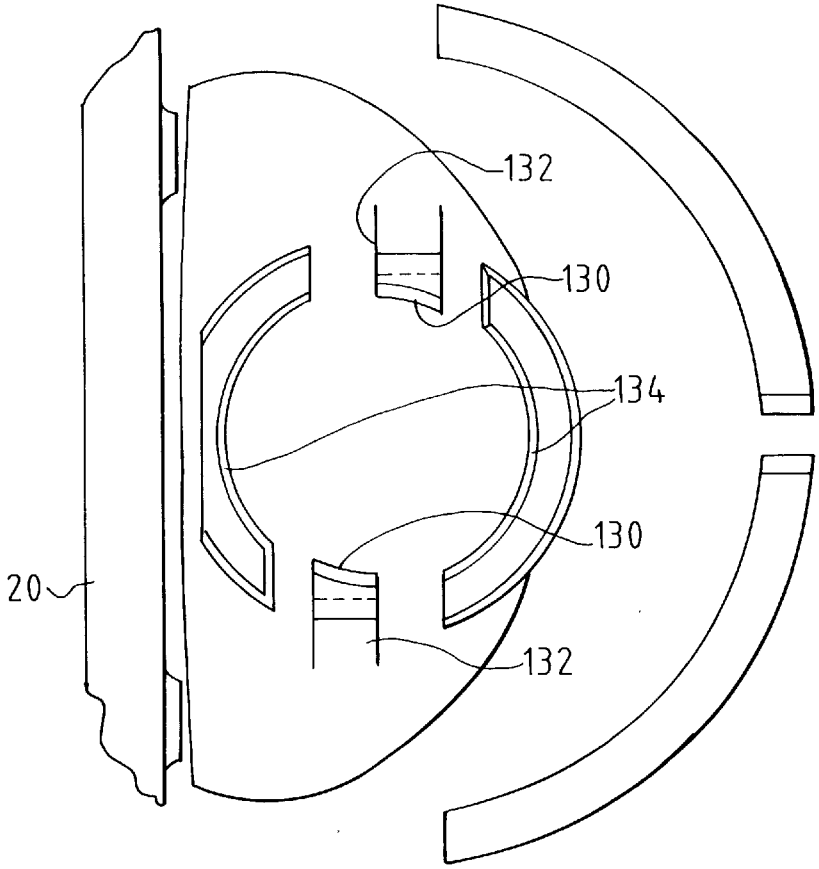
FIG. 16 is a partial enlarged bottom plan view of the mounting members of the body of the interior part of the door handle assembly of the alternative embodiment, without the thumb turn.

The cantilever arms 132 are resilient and have vertical sides 136 and inwardly facing bottom horizontal ledges 138 at their free hook or horizontal ends 130 terminating in opposing vertical faces 140. The distance between the opposing vertical faces 140 is less than the distance between the vertical sides. The free hook or horizontal ends of the cantilever arms also have ramped faces 142 extending from the vertical faces 140 to top horizontal ledges 144. As shown in FIG. 16, both the vertical and ramped faces 140, 142 of the free ends 130 of the cantilever arms 132 are curved to match the curve of the circumferential groove 102 of the cylindrical boss 66.

Figure 9:
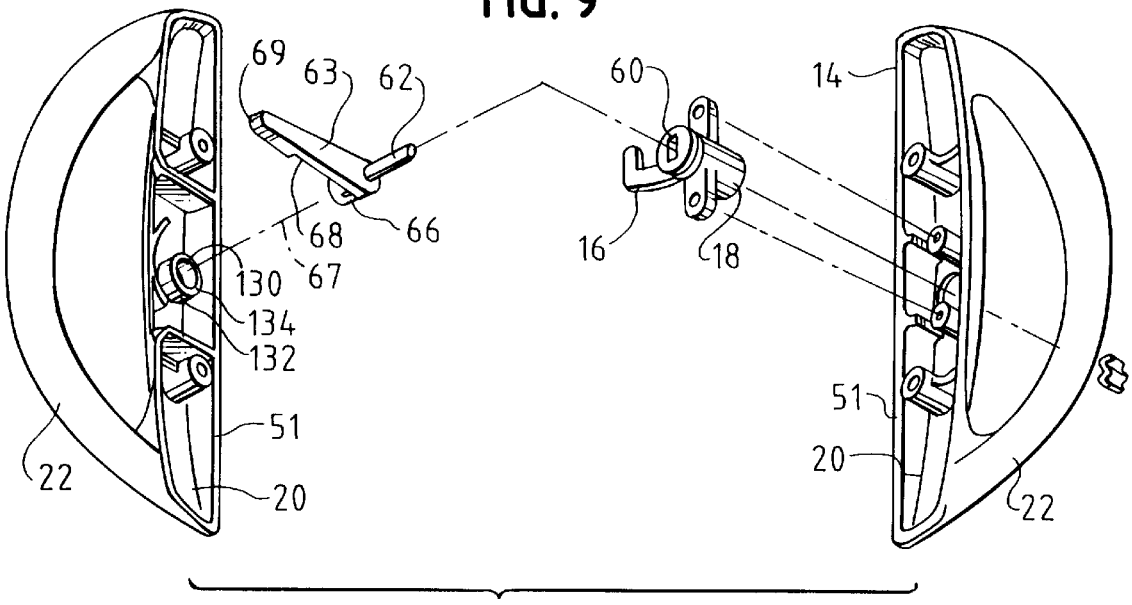
FIG. 9 is an exploded view of both the interior and exterior sides of the alternative embodiment of the door handle, showing the locking and latching mechanisms as well as the thumb turn.
Figure 14:
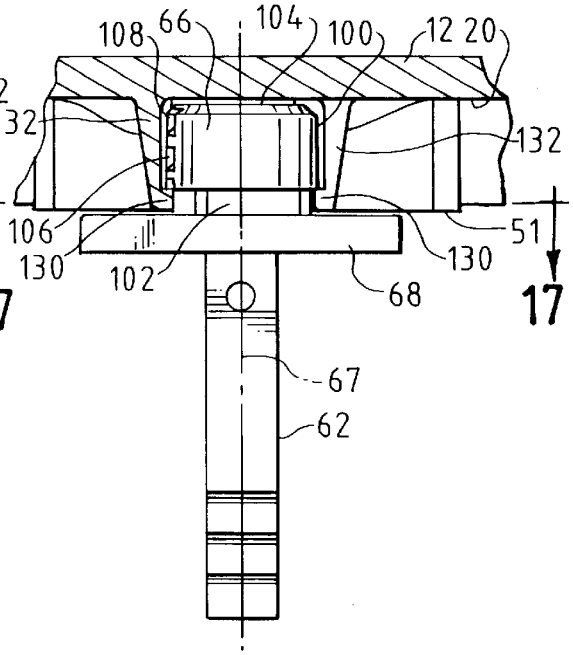
FIG. 14 is a cross-sectional view, taken along line 14—14 of FIG. 3, of the thumb turn mounted on the body of the interior part of the door handle and in position its final functional position.
Figure 17:
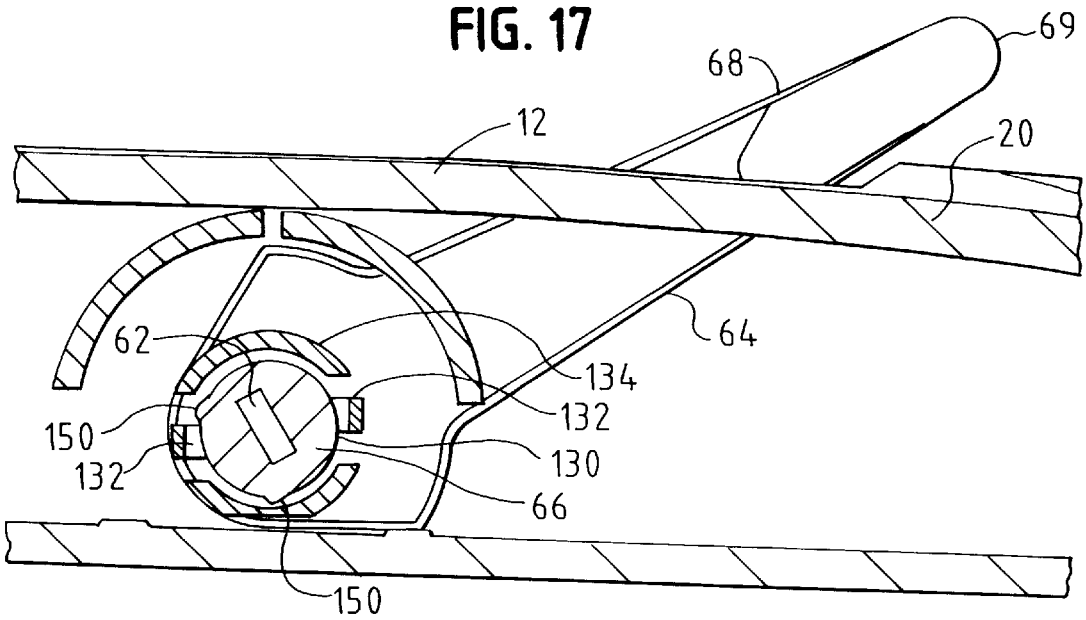
FIG. 17 a cross-sectional view of the thumb turn in position on the body of the interior part, taken along line 17—17 of FIG. 14, showing the detents of the thumb turn.

In the illustrated embodiment, the cantilever arms 132 cooperate with the ribs 134 to hold the cylindrical boss 66 in the body while allowing for free rotation of the cylindrical boss and latch control post 62 about the central axis of rotation 67 with pivotal movement of the lever arm 68 to move the latch 16 between the open and closed positions. As seen in FIGS. 9 and 17, the ribs 134 provide a partial cylindrical inner surface, of slightly larger diameter than the outer cylindrical surface of the boss 66 to partially surround the boss. The cantilever arms 132 are spaced between the ribs to substantially complete the cylindrical enclosure for the boss, although leaving some gap between the ribs and the cantilever arms as shown in FIG. 16. The free hook or horizontal ends 130 of the cantilever arms 132 engage or are received in the circumferential groove 102 of the cylindrical boss 66 to hold the boss in position in the mounting member defined by the ribs and arms while allowing for free rotational movement of the boss. Because the cantilever arms are resilient, the free hook or horizontal ends tend to stay within the circumferential groove; that is, the resilient spring action of the cantilever arms maintains them in the circumferential groove, as shown in FIG. 14, the permanent functional position for the thumb turn 64 on the body 20. In the illustrated embodiment the circumferential groove extends around the entire boss, although a shorter groove could be provided for a shorter path of motion.

Figure 13:
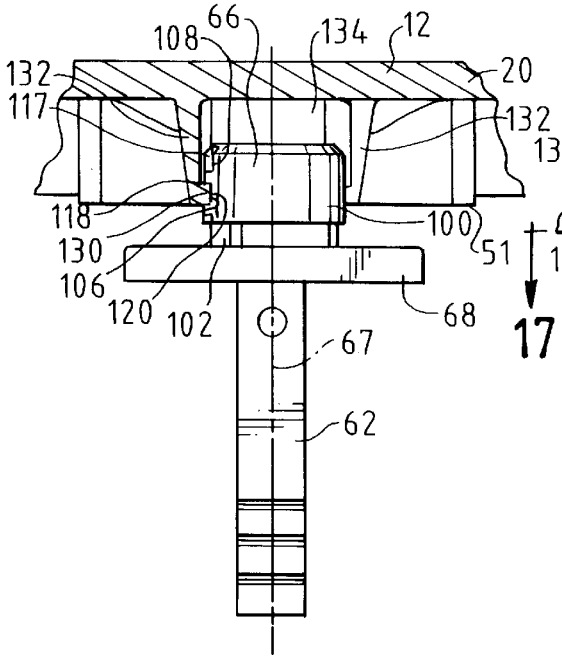
FIG. 13 is a cross-sectional view, taken along line 13—13 of FIG. 8, of the thumb turn mounted on the body of the interior part of the door handle and in its temporary position for painting.

A second, temporary position is also provided for the thumb turn on the body, one in which the thumb turn is held away from the body to prevent bridging during painting and held in the position of maximum exposure, where pivoting or rotation about the axis is prevented. This second position is shown in FIG. 13. There, the free hook or horizontal ends 130 of the cantilever arms 132 are held in the pockets 106, the pockets and free hook or horizontal ends being sized, shaped and disposed so as to be capable of receiving the free hook or horizontal ends of the cantilever arms, the sizes and shapes being complimentary so that when the free hook or horizontal ends are received in the pockets as shown in FIG. 13, rotation of the cylindrical boss and pivoting of the lever arm is prevented or at least substantially limited. As shown, when the free hook or horizontal ends are in the pockets, the thumb turn cannot rotate, so the piece can be painted.

The vertical grooves 108 serve to guide the free hook or horizontal ends 130 of the cantilever arms 132 into the recesses of the pockets 106. The grooves are sized and shaped to receive the free hook or horizontal ends and vertical sides of the cantilever arms, and the ramped faces of the free hook or horizontal ends will travel up the ramped surfaces 116 of the vertical groove until the hook ends snap into the recesses 120 of the pockets. Once there, the flat horizontal surface 118 of the pocket will limit the ability of the free ends to slip back out of the pocket.

As shown in FIG. 13, the pockets should be spaced from the lever arm a distance sufficient to hold the lever arm a sufficient distance from the outer edge 51 around the perimeter of the body to prevent bridging of paint. Thus, the thumb turn is temporarily held in the position shown in FIG. 13, where the maximum area of the lever arm is exposed outside of the body for painting, where unwanted movement out of this position is limited or prevented, and where the lever arm is held at a greater distance from the body than in use.

When painting is complete and the paint has dried sufficiently, the thumb turn may be easily moved to its permanent functional position shown in FIG. 14 simply by pushing the thumb turn further into the body 20. The ramped faces 142 on the free hook ends 130 will travel up the ramped surface 122 leading from the pocket recess 120 to the outer cylindrical surface of the boss, and then down the final ramped surface 124 and into the circumferential groove, where the free end remains until some step is taken to remove the thumb turn from the body.

To prevent the thumb turn from drooping in use, the present invention provides a pair of detents 150 on the circumferential groove 102. As shown in FIG. 17, each detent 150 is a bump that slightly expands the diameter of the circumferential groove, and which works against the spring action of the cantilever arms 132 as the lever arm 68 is pivoted. In the illustrated embodiment, the detents or bumps 150 are positioned so that they must be rotated past the free ends of the cantilever arms as the lever arm is rotated out of its two extreme positions. Thus, the illustrated detents serve to limit the pivotal movement of the lever arm when the latch is in the open and closed positions.

In the processes of making and painting with the second alternative embodiment, a latching assembly can be made by providing such an assembly and placing the boss of the thumb turn in the mounting area so that the free hook ends of the boss are held within the pockets and the free end of the lever arm is held outside of the body. The combined part may then be painted and allowed to dry. Then, the thumb turn boss may be pushed further into the mounting area of the body so that the free hook ends of the cantilever arms are positioned in the circumferential groove. If vertical grooves are provided in the boss as described, then the step of placing the boss of the thumb turn in the mounting area so that the free hook ends are held within the pockets of the boss includes the step of placing the free hook ends of the cantilever arms in the vertical grooves and pushing the boss into the body until the free hook ends engage the pockets. This process may be used for painting other products that have a pivoting member as well.

Stated in another way, in the process of the second embodiment, an assembly may be painted following the steps of first providing an assembly comprising a pivoting member, such as the thumb turn 64, and a body, such as the interior part 12 body 20, with a mounting area for pivotally mounting the pivoting member in the body, such as the mounting area provided by the combination of the ribs 134 and cantilever arms 132, the pivoting member having an exposed area outside of the body when mounted in the body, such as the exposed surface of the thumb turn. The pivoting member is temporarily mounted on the body at a first position wherein the pivoting member is prevented from pivoting and wherein the exposed area is spaced from the body, such as the position shown in FIG. 13, and the combined pivoting member and body may be painted with the pivoting member maintained at the first position. As illustrated in FIGS. 13 and 14, the distance between the exposed area and the body in the first position is greater than the distance between the exposed area and the body when the pivoting member is pivotally mounted on the body. The step of temporarily mounting the pivoting member may comprise the step of inserting a plurality of hooks, such as the horizontal ends 130 of the cantilever arms 132, into the pivoting member to limit movement of the pivoting member. When the painting process is part of a manufacturing process, the method may further comprise the step of moving the pivoting member to a final position wherein the pivoting member is closer to the body than when at the first position and wherein the pivoting member is pivotable, such as by moving the pivoting member to the position shown in FIG. 14. When hooks such as the horizontal ends of the cantilever arms are used, this step of the manufacturing process may involve removing the hooks from the pivoting member, such as by pushing the pivoting member down into the body in the illustrated embodiment, so that the pivoting member is fully received into the mounting area.

In addition to the disclosures of the United States patent application filed by Douglas A. Nolte and Raul Padilla, Jr., the disclosure of U.S. patent application Ser. No. 29/041,277 filed Jul. 11, 1995 by the present inventor, Marcia K. Blom, is fully incorporated by reference herein. As will be understood by those in the art, the structures, processes and designs disclosed in those patent applications may be successfully used in conjunction with the invention claimed herein.

While the present invention has been described in terms of illustrated embodiments, many of the innovative features of the invention disclosed could be utilized apart from the totality of features disclosed and hence would still fall within the spirit and scope of this invention. Therefore, although certain alternative and modified approaches or aspects have been disclosed or suggested herein, it also should be understood that various modifications, changes and variations may be made in the arrangement, operation and details of construction of the elements disclosed herein without departing from the spirit and scope of this invention.

I claim:

1. A low profile handle for a vertically oriented door, said handle having an interior part with a vertical length, an uppermost extent and a lowermost extent and comprising:

a generally vertically oriented body for mounting against the door, the body extending vertically to define the uppermost extent of the interior part of the handle; and a handle portion having upper and lower ends attached to the body at upper and lower junctions, the handle portion including oppositely facing sides, one of said sides lying in a plane and adapted to generally face the door when the body is mounted to the door and the other of said sides adapted to generally face away from the door when the body is mounted to the door, said other side being substantially convex relative to said plane and has a top having a high area spaced farthest from the body in a generally horizontal direction and low areas closest to the body in said horizontal direction, the low areas being at the upper and lower ends of the handle portion, the low area at the upper end of the handle portion extending substantially to the uppermost extent of the interior part of the handle and the high area being generally centrally vertically disposed on said handle portion, wherein the distance between the top of the other side of the handle portion and the body in said horizontal direction gradually and continuously decreases in conjunction with increasing vertical distance from the handle portion other side high area to the handle portion other side low areas so that the top of the handle portion other side curves continuously smoothly from said high area to said low areas and to a point approximately at the uppermost extent of the interior part of the handle, said body having a vertical center line and horizontally spaced edges, the handle portion defining a graspable portion spaced substantially entirely horizontally to one side of the vertical center line, the handle portion other side extending from the vertical center line to the other side of the vertical center line, there being no upwardly opening gap between either a) the handle and the door to which the body is adapted to be mounted or b) the handle and the body that could receive a horizontally extending slat on a blind that is adapted to be moved downwardly against the door, down to, against, and downwardly past the interior part of the handle.

2. The low profile handle according to claim 1 wherein the body extends continuously from the uppermost extent of the interior part of the handle to define the lowermost extent of the interior part of the handle.

3. The low profile handle according to claim 2 wherein the low area at the lower end of the handle portion extends substantially to the lowermost extent of the interior part of the handle.

4. The low profile handle according to claim 3 wherein the top of the handle portion other side curves continuously from the point approximately at the uppermost extent of the interior part of the handle to a point approximately at the lowermost extent of the interior part of the handle.

5. The low profile handle according to claim 4 wherein the top of the handle portion other side is convexly curved fully between the points approximately at the uppermost and lowermost extent of the interior part of the handle.

6. The low profile handle according to claim 5 wherein the top of the handle portion other side is continuously convexly curved from the one side of the vertical center line to adjacent the horizontally spaced edge at the other side of the vertical center line.

7. The low profile handle according to claim 6 wherein the top of the handle portion other side is continuously curved from the horizontally spaced edge at the other side of the vertical center line adjacent the point approximately at the uppermost extent of the interior part of the handle to beyond the vertical center line to the one side of the vertical center line and back to the horizontally spaced edge at the other side of the vertical center line adjacent the point approximately at the lowermost extent of the interior part of the handle.

8. The low profile handle according to claim 6 wherein the body has a vertical length and the body is capable of being mounted against the door along substantially the entire vertical extent of the body.

* * * * *